United States Patent [19]

Furness

[11] 4,104,777

[45] Aug. 8, 1978

[54] REPAIR OF BOTTLE TOP MOLDS

[75] Inventor: John Douglas Furness, Glamorgan, Wales

[73] Assignee: Hilti Aktiengesellschaft, Schaan, Liechtenstein

[21] Appl. No.: 586,934

[22] Filed: Jun. 16, 1975

[30] Foreign Application Priority Data

Jun. 18, 1974 [GB] United Kingdom ..... 26874/74

[51] Int. Cl.[2] ..... B23P 7/00; B22D 19/10; B22D 7/06

[52] U.S. Cl. ..... 29/401 D; 29/401 A; 29/401 E; 164/92; 249/174; 249/204

[58] Field of Search ..... 228/241; 164/53, 55, 164/92, 57; 249/86–88, 197, 174, 202, 204, DIG. 5; 29/401 R, 401 B, 401 C, 401 D, 401 E, 401 F; 264/30, 36

[56] References Cited

U.S. PATENT DOCUMENTS

| | | | |
|---|---|---|---|
| 1,765,382 | 6/1930 | Messler et al. | 249/202 |
| 1,933,772 | 11/1933 | Stresau | 29/401 R X |
| 2,070,532 | 2/1937 | Gathmann | 249/174 |
| 2,120,525 | 6/1938 | McKerihan | 29/401 |
| 2,390,624 | 12/1945 | Stone | 29/401 |
| 2,692,425 | 10/1954 | Martin | 29/401 |
| 3,103,721 | 9/1963 | Bischop et al. | 249/86 |
| 3,136,044 | 6/1964 | Funk et al. | 164/92 |
| 3,322,390 | 6/1967 | Glaesner | 249/174 |
| 3,477,683 | 11/1969 | La Bate | 249/174 |

FOREIGN PATENT DOCUMENTS

| | | | |
|---|---|---|---|
| 545,347 | 3/1956 | Canada | 29/401 |
| 410,006 | 3/1945 | Italy | 249/197 |
| 595,947 | 9/1958 | Italy | 29/401 |
| 946 | 11/1971 | Japan | 29/401 |

*Primary Examiner*—Francis S. Husar
*Assistant Examiner*—Gus T. Hampilos
*Attorney, Agent, or Firm*—Toren, McGeady and Stanger

[57] ABSTRACT

In bottle top molds a plug is used as a closure for the opening in the top wall of the molds through which the molten metal is poured. The surface of the opening tends to become eroded by the molten metal flowing into the mold and, as a result, the plug no longer forms an effective closure rendering the mold unusable. To prolong the useful life of the mold, a ring-shaped member is secured to the top wall of the mold in register with the opening and covering the eroded surface. The ring-shaped member is configured to receive the plug so that it continues to form a closure for the mold.

3 Claims, 5 Drawing Figures

REPAIR OF BOTTLE TOP MOLDS

SUMMARY OF THE INVENTION

The present invention is directed to bottle top molds, that is, ingot molds of the type used in steel making where the top of the mold has only a relatively small diameter opening for teeming molten metal into it, and, more particularly, it concerns an arrangement for repairing the opening into the mold so that a circular plug can continue to be used as a closure for the mold.

In the use of bottle top molds, erosion occurs about the edge of the opening into the mold due to the impingement of molten metal as it flows into the mold. If such erosion occurs, the plug no longer forms a proper closure for the opening and, as a consequence, bleeding of molten metal can occur between the plug and the surface of the opening. When this happens, the mold is, for all practical purposes, substantially useless.

Therefore, it is a primary object of the present invention to repair the top of the mold so that the plug can continue to form an effective closure, whereby such molds, which are quite expensive, can be continued in use.

In accordance with the present invention, a method and apparatus for repairing the opening in the top of the bottle top mold is provided. Basically, the repair involves the securement of a ring-shaped member to the top wall of the mold with the member forming an aperture for receiving the plug so that an effective closure is provided.

In a preferred embodiment of the invention, the ring-shaped member has a height in the axial direction of its aperture or opening which is approximately ½ of its radial width, for example, it has a height of approximately 1 inch and a radial width of approximately 2 inches.

The repair of the opening in the top of the mold can be carried out in various ways. In one procedure a prefabricated ring is used as the ring-shaped member. The ring has an annular row of holes extending through it, parallel with the axis of the opening through the ring. After the ring is positioned on the top of the mold so that the axis of its opening is aligned with the axis of the opening in the mold, hard metal fasteners are driven through the holes in the ring into the mold itself. A cartridge-powered fastener-driving tool is used for inserting the fasteners. The fasteners secure the ring in position.

Alternatively, the prefabricated ring can be secured in position by welding it to the top of the mold.

However, the preferred method for forming the ring-shaped member involves positioning refractory shuttering or formwork on the top wall of the mold to define the ring-shaped member aligned with the opening in the mold. A molten metal, prepared by the welding technique known commercially as aluminothermic welding, is poured into the formwork causing a welding of the metal to the mold and forming the ring-shaped member in register with the mold opening.

This latter procedure is preferred because the superheating developed in the powder fusion contributes toward a particularly secure attachment of the ring-shaped member to the mold top. Furthermore, the molten metal, developed in the fusion action, flows into and fills all of the spaces or gaps defined between the mold opening and the refractory shuttering.

The present invention also includes bottle top molds repaired in accordance with the above procedures.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
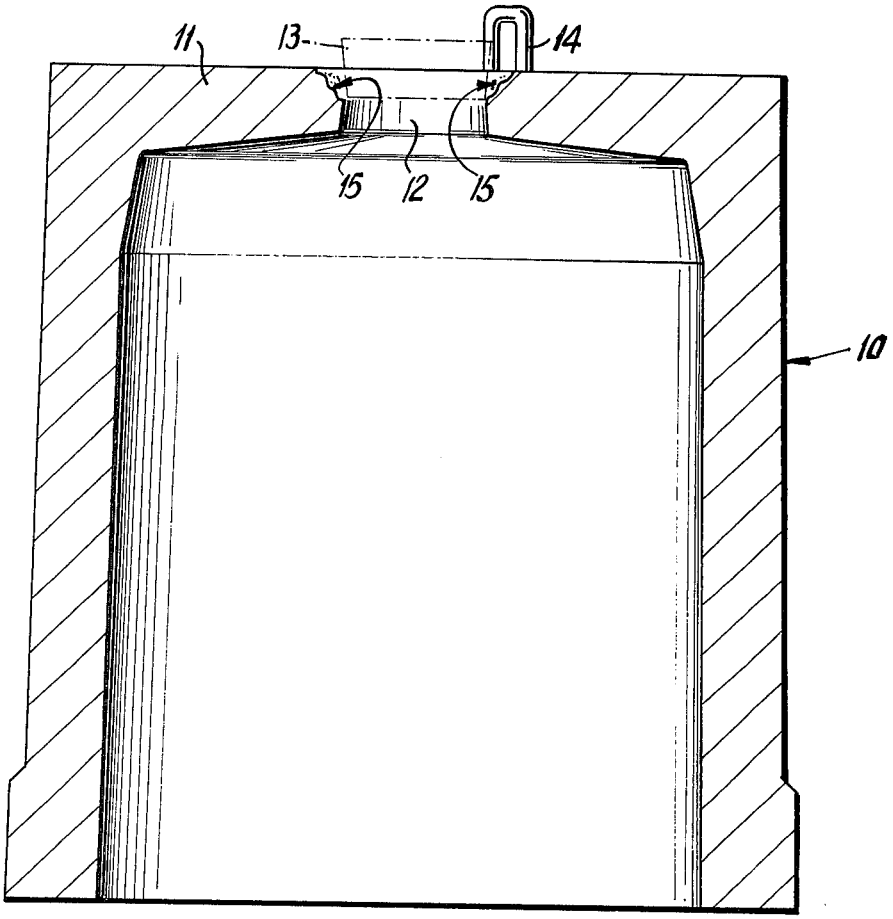
FIG. 1 is a vertical sectional view illustrating a typical bottle top mold whose opening has been eroded and requires repair.
Figure 2:
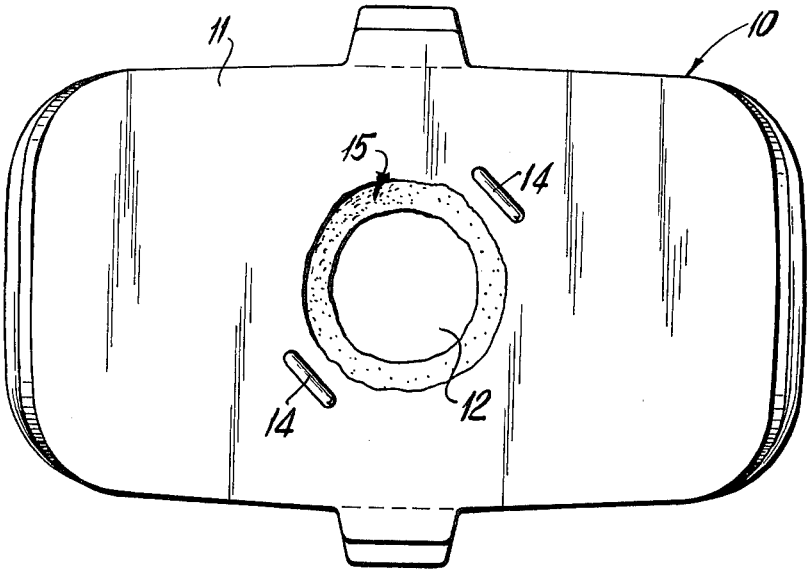
FIG. 2 is a plan view of the mold shown in FIG. 1.

In FIGS. 1 and 2 a conventional bottle top mold 10 is shown having a top wall 11 extending over the space within the mold with an opening 12 located substantially centrally in and through the top wall. A plug 13 is shown in phantom in the position it normally assumes in closing the opening 12. Chaplets 14 are provided one on each side of the opening 12 so that a retainer bar, not shown, can be inserted through the chaplets extending across the top of the plug 13 for holding it in place.

In both FIGS. 1 and 2, the edge of the opening 12 has been eroded, as indicated at 15, by the impingement on the opening surface of molten metal as it is teemed into the mold 10. As a result of the erosion of the opening, the plug no longer seats properly within the opening with the result that the mold can no longer be used.

Figure 3:
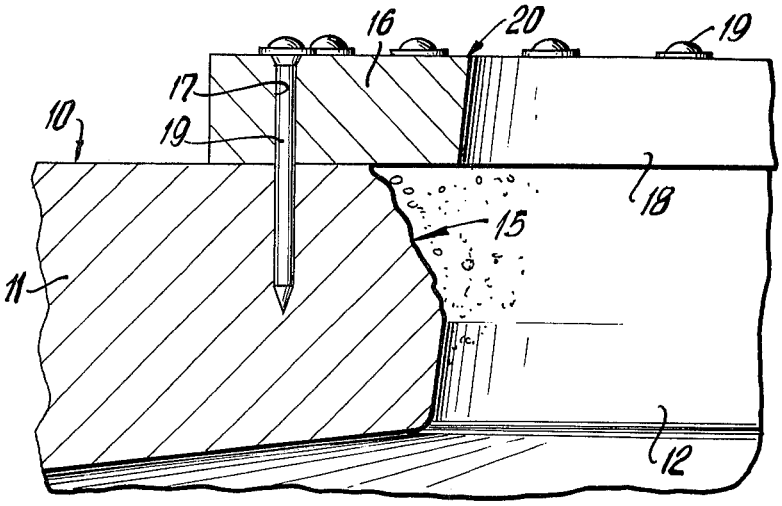
FIG. 3 is an enlarged partial sectional view illustrating one procedure for repairing the molds in accordance with the present invention.
Figure 4:
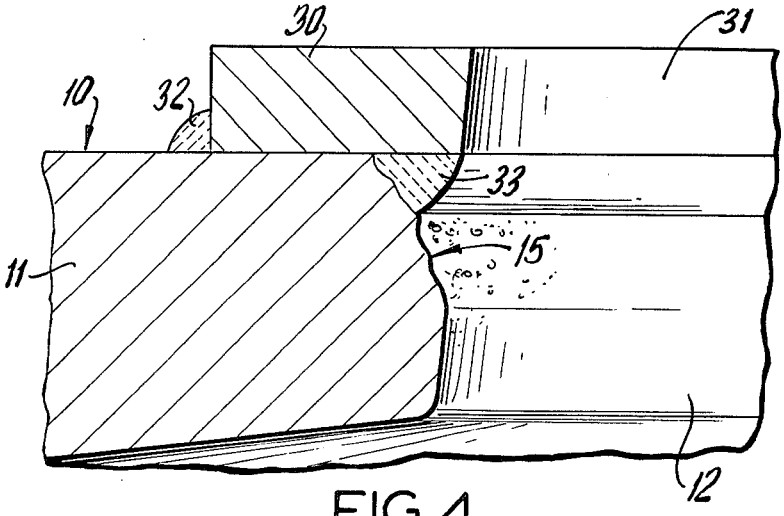
FIG. 4 is a sectional view similar to FIG. 3, but illustrating another repair procedure in accordance with the present invention.
Figure 5:
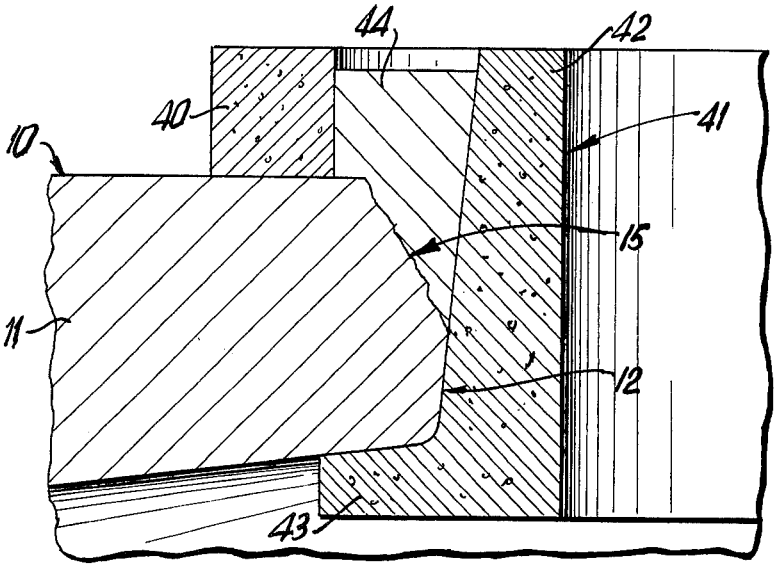
FIG. 5 is a sectional view, similar to FIGS. 3 and 4, but illustrating still another procedure for repairing the mold, in accordance with the present invention.

FIGS. 3, 4 and 5 illustrate three different procedures for repairing the eroded opening 12 in the mold so that the plug 13 can provide an effective closure with the useful life of the mold being extended.

In FIG. 3, a prefabricated metal ring 16 is shown having an array of holes 17 extending therethrough at appropriate intervals, which may be regular or irregular. The ring 16 forms a central opening 18. The axes of the holes 17 are in substantially parallel relation with the axis of the opening 18. The ring 16 is located on the top wall 11 of the mold 10 so that the axis of its opening 18 is in general alignment with the axis of the opening 12 in the top wall 11 of the mold and the surface defining the opening 18 is in register with the original surface defining the opening 12, that is, before the surface of the opening was eroded. Hard, nail-like fasteners 19 are driven through each of the holes 17 into the top wall 11 to secure the ring 16 to the mold. An explosive-powered fastener-driving tool can be used for inserting the fasteners 19. The opening 18 provides the necessary sharp edge 20 for cooperation with the plug 13 for closing the mold 10 in the same manner as it was closed before its original opening 12 has been damaged.

The height of the ring 16 in the axial direction of the opening 18 is approximately ½ of the width of the ring 16 in its radial direction.

In FIG. 4 a prefabricated metal ring 30 is shown positioned with its opening 31 in register with the opening 12 in the top wall of the mold. In this embodiment, however, the ring 30 is secured to the top wall 11 by welding. Two weld beads are used in securing the ring to the mold, one weld bead 32 secures the radially outer side of the ring to the upper surface of the top wall and a second weld bead 33 joins the underside of the ring adjacent its radially inner edge to the eroded surface 15 adjacent the upper surface of the top wall.

If desired, the welding technique illustrated in FIG. 4 can be applied to the ring 16 secured by fasteners, as illustrated in FIG. 3, with the gap or recess occurring between the eroded surface 15 and the undersurface of the ring 16 being partly or wholly filled with weld metal. Alternatively, of course, the fastening technique of FIG. 3 can be employed to supplement the welding technique illustrated in FIG. 4.

However, the preferred procedure for forming the ring-shaped member about the opening in the mold, is illustrated in FIG. 5. In the procedure shown in FIG. 5 refractory shuttering or formwork is used to form the ring-shaped member.

The refractory shuttering is essentially in two parts, one part is an outer ring 40 and the other part is an inner ring 41. Each of the inner and outer rings can be made up of a plurality of segments or sections. The outer ring 40 is substantially rectangular in cross-section having a height extending upwardly from the top wall 11 of the mold which is greater than the desired height of the metal ring-shaped member to be formed. The inside diameter of the outer ring 40 is substantially equal to the desired outside diameter of the ring-shaped member. At one point about its circumference, the outer ring 40 has a slag flow-off notch, not shown, the lowest point of which coincides substantially with the desired level of the upper surface of the ring-shaped member.

Inner ring 41 has an angled configuration or, as viewed in FIG. 5, a J-shaped cross-section. The ring has a main section 42 whose outer surface corresponds to the desired tapered inside surface of the opening in the ring-shaped member to be formed on the top wall 11. An outwardly-projecting flange 43 is secured to the lower end of the main section 42 and extends outwardly and seats against the undersurface of top wall 11 adjacent the opening 12. The main section projects upwardly from the flange 43 through the opening 12 to the plane of the upper surface of the outer ring 40.

The outer ring 40 and inner ring 41 define, in combination with the upper surface of the top wall 11 and the eroded surface 15 of the opening 12, the boundaries of a ring-shaped member 44. The ring 44 is simultaneously formed and welded to the top wall of the mold by a metal powder fusion or aluminothermic technique, such as that known as the "Thermit" process. In such process, a metal preparation containing welding metal oxide, which is converted to weld metal subjected to heat, in the presence of aluminum, is filled into a crucible positioned above the formwork on top of the mold, and the powder is ignited. The ignition results in the rapid production, in the crucible, of a molten weld metal which is superheated to the extent that its temperature is some hundreds of degrees centigrade above the melting temperature of the metal. This molten metal is then poured into the upwardly-open gap between the inner and outer rings 40,41, after the top wall 11 of the mold has been preheated by playing a hot flame on it. The metal poured into the formwork solidifies and forms the ringshaped member 44 with a strong welded connection between the member and the eroded surface 15 of the opening 12 in the mold. The formation of the ring-shaped member in this manner assures that any eroded portions of the top wall of the mold are replaced by weld metal.

Molds repaired in accordance with the invention are suitable for repeated re-use and, of course, provide a secure seat for the plug 13, eliminating the possibility of the molten metal bleeding from the mold 10.

Naturally the invention is not confined to the precise details of the foregoing examples and variations may be made. For example, it is possible to carry the method of the invention into effect by welding a prefabricated metal ring in place of the welding techniques comparable with that described in the reference to FIG. 5.

While specific embodiments of the invention have been shown and described in detail to illustrate the application of the inventive principles, it will be understood that the invention may be embodied otherwise without departing from such principles.

I claim:

1. In a bottle top mold having an opening in the top of the mold through which molten metal is poured into the mold and a plug arranged to seat in the opening and afford an effective closure, the method of repairing an eroded surface in the opening in which the plug seats with the eroded surface preventing an effective closure of the opening by the plug, comprising positioning a ring-shaped member with an opening therein arranged to receive the plug for the mold over the eroded opening in the top of the mold and with the ring-shaped member in contact with the top of the mold and located above the eroded surface for completely covering the upper portion of the eroded surface of the opening with the central axis of the ring-shaped member in axial alignment with the central axis of the opening in the top of the mold and with the surface defining the opening in the ring-shaped member in register with the surface which originally defined the mold opening and securing the ring-shaped member to the mold so that the plug in the opening in the ring-shaped member affords an effective closure of the opening in the mold, forming the ring-shaped member with its height in the axial direction of its opening approximately one-half of its width in the radial direction, and securing the ring-shaped member to the top of the mold by explosively driving fastening members through the ring-shaped member into the top of the mold.

2. In a bottle top mold comprising a mold having a mold space therein, a top wall disposed across the top of the mold space, said top wall having an upper surface, a lower surface and an opening having a central axis with the opening passing from the upper surface to the lower surface for teeming molten metal into the mold space, and a plug insertable downwardly into the opening for contacting the upper surface of the top wall of said mold and forming an effective closure of the opening, the surface of the opening extending downwardly from the upper surface of said wall being subject to erosion due to being contacted by molten metal teeming into the mold space so that with continued use of the mold and erosion of the opening said plug cannot form an effective closure for the mold space, wherein the improvement comprises means securable to said top wall about the opening forming a ring-shaped member projecting upwardly from the upper surface of said top wall and encircling the axis of the opening for receiving said plug so that an effective closure can be provided for the mold space, said ring-shaped member having a central axis aligned with the central axis of the opening in the top of the wall of the mold and the surface defining the opening through the ring-shaped member aligned with the surface defining the original opening in the top wall of the mold, said ring-shaped member supported on and extending upwardly from the upper surface of said top wall and having a plurality of holes formed through said member in the axial direction of the opening therethrough, and fastening members insertable by an explosive powder driven setting gun driven through said holes and into said top wall of said mold for securing said member to said mold.

3. In a bottle top mold, as set forth in claim 2, wherein said ring-shaped member has the dimension in the axial direction of the opening approximately equal to ½ of the dimension of said ring-shaped member measured in the radial direction.

* * * * *